US011428024B2

(12) United States Patent
Palmer

(10) Patent No.: US 11,428,024 B2
(45) Date of Patent: Aug. 30, 2022

(54) SECURITY MESH

(71) Applicant: Jake Ross Palmer, Gerrardstown, WV (US)

(72) Inventor: Jake Ross Palmer, Gerrardstown, WV (US)

( * ) Notice: Subject to any disclaimer, the term of this patent is extended or adjusted under 35 U.S.C. 154(b) by 92 days.

(21) Appl. No.: 16/800,041

(22) Filed: Feb. 25, 2020

(65) Prior Publication Data

US 2020/0270896 A1 Aug. 27, 2020

Related U.S. Application Data

(60) Provisional application No. 62/809,794, filed on Feb. 25, 2019.

(51) Int. Cl.

| | |
|---|---|
| ***E04H 17/16*** | (2006.01) |
| ***E04H 17/08*** | (2006.01) |
| ***E04H 17/20*** | (2006.01) |
| ***E04H 17/04*** | (2006.01) |
| ***E04H 17/10*** | (2006.01) |

(52) U.S. Cl.

CPC ..... *E04H 17/161* (2013.01); *E04H 17/04* (2013.01); *E04H 17/08* (2013.01); *E04H 17/10* (2013.01); *E04H 17/20* (2013.01)

(58) Field of Classification Search

CPC ..... E04H 17/16; E04H 17/161; E04H 17/164; E04H 17/17; E04H 17/02; E04H 17/05; E04H 17/06; E04H 17/10; E04H 17/124

See application file for complete search history.

(56) References Cited

U.S. PATENT DOCUMENTS

| | | | | | |
|---|---|---|---|---|---|
| 2,019,379 | A * | 10/1935 | Anderson | E06B 9/15 | 160/235 |
| 3,481,094 | A * | 12/1969 | Taylor | E04F 13/12 | 52/394 |
| 4,283,897 | A * | 8/1981 | Thompson | E04B 1/80 | 52/478 |
| 4,699,251 | A * | 10/1987 | Orndorff | B66B 11/0226 | 187/401 |
| 5,379,564 | A | 1/1995 | Wynne | | |
| 5,842,545 | A * | 12/1998 | Blaiotta | B66B 11/0253 | 187/401 |
| 6,082,501 | A * | 7/2000 | Lehmann | B66B 11/0253 | 187/401 |
| 6,311,955 | B1 * | 11/2001 | McGarry | E04H 17/1417 | 256/24 |
| 7,152,535 | B2 | 12/2006 | Mikich et al. | | |
| 7,882,667 | B2 * | 2/2011 | Smith | E04B 1/08 | 52/282.3 |

(Continued)

FOREIGN PATENT DOCUMENTS

| | | |
|---|---|---|
| DE | 102006024070 | 2/2012 |
| EP | 0098328 | 10/1992 |

(Continued)

*Primary Examiner* — Jonathan P Masinick

(74) *Attorney, Agent, or Firm* — Benjamin C. Rothermel, Esq.

(57) ABSTRACT

The present disclosure relates to a security mesh. The security mesh includes a first sheet and a second sheet. A first portion of the first sheet is adjacent to a first portion of the second sheet along a first direction, and a second portion of the first sheet overlaps a second portion of the second sheet along a second direction perpendicular to the first direction.

20 Claims, 2 Drawing Sheets

(56) References Cited

U.S. PATENT DOCUMENTS

| | | | | |
|---|---|---|---|---|
| 8,613,130 | B2 | 12/2013 | Larsen | |
| 9,091,096 | B2 | 7/2015 | Cochrane | |
| 9,695,613 | B2 | 7/2017 | Shepherd | |
| 2006/0175590 | A1 | 8/2006 | Fumagalli | |
| 2008/0229678 | A1* | 9/2008 | Goddard | E04B 2/7453 52/63 |
| 2010/0058688 | A1 | 3/2010 | Goddard | |
| 2011/0079761 | A1 | 4/2011 | Young | |
| 2017/0254110 | A1* | 9/2017 | Goodrich | E04H 17/168 |

FOREIGN PATENT DOCUMENTS

| | | |
|---|---|---|
| FR | 2884543 | 9/2008 |
| GB | 1032475 | 6/1966 |
| GB | 1518758 | 6/1978 |
| GB | 2299100 | 9/1996 |

* cited by examiner

SECURITY MESH

CROSS-REFERENCE TO RELATED APPLICATION

This application claims priority from U.S. Provisional Patent Application No. 62/809,794, filed on Feb. 25, 2019, which is hereby incorporated by reference for all purposes as if fully set forth herein.

BACKGROUND

Field

Exemplary embodiments relate to a security mesh.

Discussion of the Background

Typically, security mesh may be installed using framed panels or heavy backing to fasten the mesh to and therefore hold its shape, but this may be time consuming and present challenges in areas with obstructions.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a security mesh having sheets of an interlocking material having several bends and lengthwise channels, and a method of forming the same.

Exemplary embodiments provide a security mesh having expandable posts.

Additional aspects will be set forth in the detailed description which follows, and, in part, will be apparent from the disclosure, or may be learned by practice of the inventive concept.

According to exemplary embodiments, a security mesh includes a first sheet and a second sheet. A first portion of the first sheet is adjacent to a first portion of the second sheet along a first direction, and a second portion of the first sheet overlaps a second portion of the second sheet along a second direction perpendicular to the first direction.

According to exemplary embodiments, a security mesh also includes an expandable post, and a first sheet and a second sheet vertically disposed adjacent to each other along the expandable post. A first portion of the first sheet is adjacent to a first portion of the second sheet along a vertical direction, and a second portion of the first sheet overlaps a second portion of the second sheet along a horizontal direction extending away from the expandable post.

According to exemplary embodiments, a security mesh also includes an expandable post, and a first sheet and a second sheet vertically disposed adjacent to each other along the expandable post. A first portion of the first sheet is adjacent to a first portion of the second sheet along a vertical direction, a second portion of the first sheet overlaps a second portion of the second sheet along a horizontal direction extending away from the expandable post, and a third portion of the first sheet overlaps a third portion of the second sheet along the vertical direction. The second portion of the first sheet, the third portion of the first sheet, the second portion of the second sheet, and the third portion of the second sheet together form an interlocking channel along a horizontal length of the first sheet and the second sheet.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
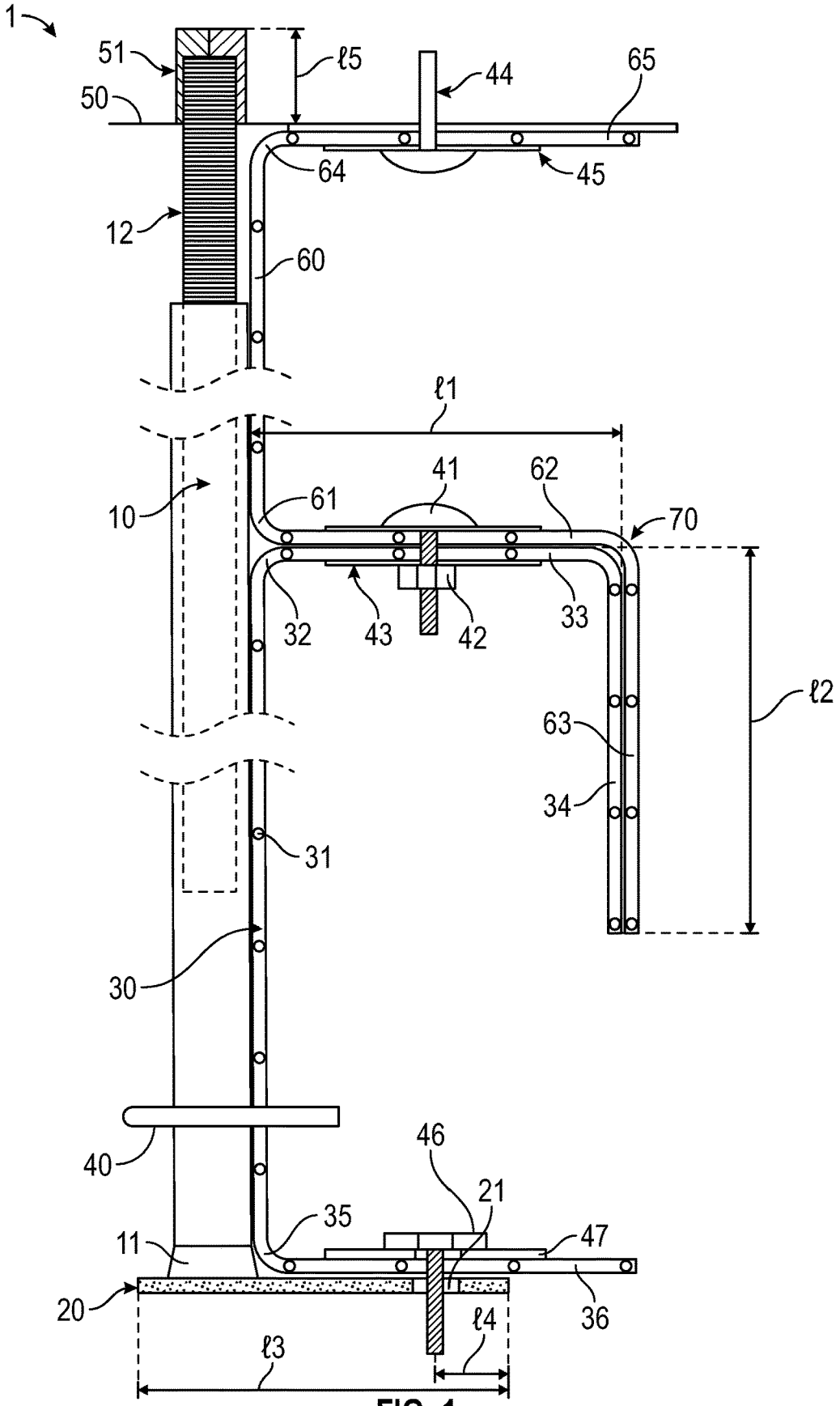
FIG. 1 is a side view of a security mesh according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
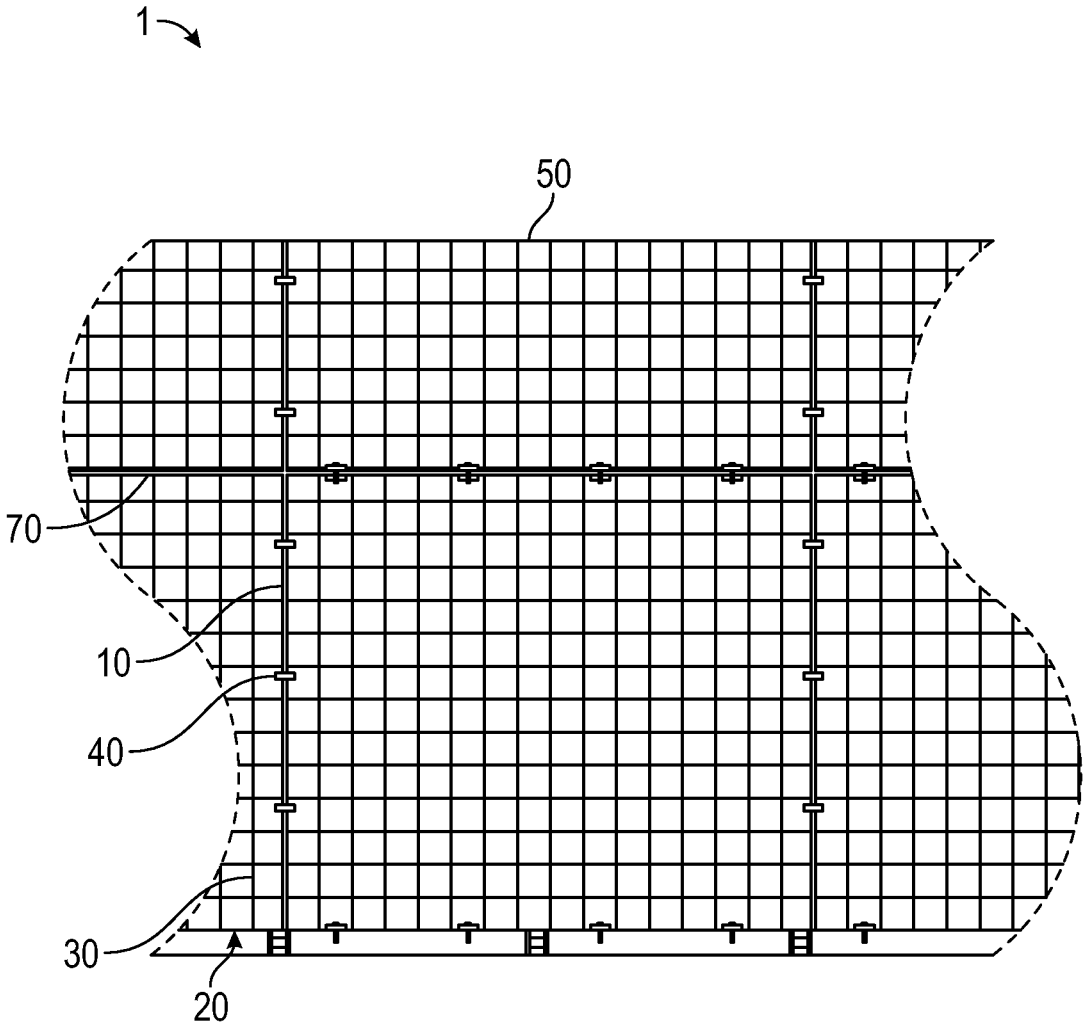
FIG. 2 is a front view of the security mesh of FIG. 1 according to the present exemplary embodiment.

A security mesh 1 according to an exemplary embodiment of the present inventive concept, as shown in FIG. 1 and FIG. 2, includes sheets of an interlocking material such as expanded metal, welded, or woven wire having several bends and lengthwise channels, and a method of forming the same.

By making a series of different bends lengthwise on the sheets of interlocking material, the need for framing may be eliminated and backing may be reduced to a minimal amount. According to the present exemplary embodiment, using bent interlocking material sheets also allows the use of fasteners on an inner flange of the security mesh 1, which is far less accessible from an unsecure side of the security mesh 1. This increases security and tamper resistance.

Particularly, the security mesh 1 according to the present exemplary embodiment includes a first sheet 30 that interlocks with a second sheet 60 along an interlocking "J" interface 70. The first sheet 30 and second sheet 60 include vertically aligned, parallel panels of wires. Both the first sheet 30 and second sheet 60 are shown having a broken-away portion, indicating that each may have greater lengths than shown in FIG. 1. Security mesh panels may generally have a length of 48 inches. The security mesh 1 panels also include horizontally aligned, parallel cross-wires 31. The cross-wires 31 are substantially orthogonal to the wires of the first sheet 30 and second sheet 60.

The first sheet 30 has a bend 32, and the second sheet 60 has a corresponding bend 61, which are each substantially about 90°. Accordingly, a first flange 33 of the first sheet 30 and a first flange 62 of the second sheet 60 are horizontally aligned, and have a length l1. The first sheet 30 has another bend 32, and the second sheet 60 has a corresponding bend 61, which are each substantially about 90°. Accordingly, a second flange 34 of the first sheet 30 and a second flange 63 of the second sheet 60 are horizontally aligned, and have a length l2. In the present exemplary embodiment, the second flanges 34, 63 extends towards a base flange 36 of the first sheet 30, and the second flanges 34, 63 are substantially parallel to the first sheet 30 and the second sheet 60.

The first flange 33 of the first sheet 30 and the first flange 62 of the second sheet 60 are connected to each other by a bolt 41 secured by a nut 42. The bolt 41 may be a carriage bolt. A washer 43 may be disposed between the first flange 62 and the bolt 41, and another washer 43 may be disposed between the first flange 33 and the nut 42. The bolt 41 and nut 42 are disposed on an interior side of the security mesh 1. That is, when the security mesh 1 is installed, the first flange 33 of the first sheet 30 and the first flange 62 of the second sheet 60 extent towards a secure interior region of the security mesh 1. Since the bolt 41 and nut 42 are on the first flanges 33, 62, they also are in the secure interior region of the security mesh 1.

Due to its location on the first flanges 33, 62, it may be difficult for the bolt 41 to be reached by normal intrusion methods, such as a hand tool. Security of the security mesh 1 may therefore be increased because the first sheet 30 and second sheet 60 cannot be easily disconnected from each other. The bolt 41 and nut 42 may alternatively be disposed on the second flanges 34, 63 to connect the first sheet 30 and second sheet 60 on the interface 70, or there may be bolts and nuts on both the first flanges 33, 62 and second flanges 34, 63.

According to the present exemplary embodiment, interlocking "J" interface 70 and double-bend first and second sheets 30, 60 achieve a straight, more rigid appearance, are much stronger than material simply fastened to posts or frames, and installation is also faster. The interlocking "J" interface 70 and double-bends of the first and second sheets 30, 60 add structural strength and avoid a wavy appearance along the length of the security mesh 1. Data centers, where the security mesh 1 may be installed, typically utilize raised floors 20 held up by posts on 2-foot centers, and ceiling grid structures suspended by all-thread on 4-foot centers. The security mesh 1 according to the present exemplary embodiment integrates very well into this typical data center environment using existing floor and ceiling grid structures for support.

A security mesh may be anchored to a floor or base structure. In the security mesh 1 of the present exemplary embodiment, as shown in FIG. 1, the base flange 36 of the first sheet 30 is anchored to a floor 20. The first sheet 30 has a bend 35, which is substantially about 90°, thus forming the base flange 36. The floor 20 may be a concrete floor structure. A bolt 46 extends through the base flange 36 and through-hole 21 in the floor 20. A washer 47 may be disposed between the base flange 36 and the bolt 46.

The floor 20 may be a foot plate, having a length l3, made of metal or other material. The bolt 46 may be spaced apart from a first edge of the floor 20 by a length l4. Here, the foot plate floor 20 may be bolted to a ceiling grid or floor grid. The foot plate floor 20 may be used in conjunction with an expandable post according to an exemplary embodiment, as described below.

A security mesh may likewise be anchored to a ceiling or ceiling structure. According to the security mesh 1 of the present exemplary embodiment, a ceiling flange 65 of the second sheet 60 is anchored to a ceiling 50. The second sheet 60 has a bend 64, which is substantially about 90°, thus forming the ceiling flange 65. A bolt 44 extends through the ceiling flange 65. A washer 45 may be disposed between the ceiling flange 65 and the bolt 44.

An expandable post according to an exemplary embodiment, as shown in FIG. 1 and FIG. 2, may be used in data centers above the ceiling and between grid systems, such as a Gordon Grid, and in other ceiling and/or roof structures, as a means of backing or support for a security mesh. The expandable post may specifically provide backing or support for the security mesh 1 described above. The expandable posts may be easily added where needed in a grid system.

According to the present exemplary embodiment, the expandable post is made of a piece of first tube 10 having a substantially hollow interior diameter. The first tube 10 may be ½-inch outer diameter drawn-over-mandrel ("DOM") tubing, for example. A foot plate floor 20 may be welded to the bottom of the first tube 10 via weld 11, and act a mounting surface. A piece of second tube 12 is disposed in the first tube 10. The second tube 12 has an outer diameter less than the interior diameter of the first tube 10, so that there may only be a slight amount of resistance when the second tube 12 may be expanded or contracted within the first tube 10.

The expandable post may quickly bolt to a Gordon grid or similar grid system, and may expand to reach a uni-strut, beam clamp, anchor, or other methods of securement. The expandable post allows a user to bridge various gaps quickly with little to no measuring as may expands to nearly twice its original length according to the present exemplary embodiment, and can be manufactured to different specifications.

The security mesh 1 is connected to the expandable post via at least one connector 40, which may be a U-bolt or the like. Accordingly, once the expandable post is installed, such as in a data center grid system, the first sheet 30 and second sheet 60 are be connected to the expandable post. The security mesh 1 including the first sheet 30 and second sheet 60 having the interface 70, as described above, may be formed according to the method as described in detail below.

A method of forming the security mesh 1 according to an exemplary embodiment is described as follows. It may be necessary to install the security mesh 1 in an area of a building between a pre-existing floor grid and ceiling grid, but not on pre-set posts. For example, in a data center, posts are typically set on a 4-foot grid, where security mesh may be connected to the posts between a floor grid and a ceiling grid. However, there may be partitioned areas within the data center, making it necessary to install security mesh not on the 4-foot post grid, such as on a 2-foot grid. Expandable posts as described herein with respect to FIG. 1 and FIG. 2 are installed at the appropriate grid dimensions between the floor 20 and the ceiling 50, then the security mesh 1 connected thereto. That is, a first sheet 30 and a second sheet 60 are connected to the expandable posts using connectors 40. The first sheet 30 and second sheet 60 overlap each other at the interface 70.

Although not shown, the first sheet 30 and second sheet 60 have vertical seams, as well as horizontal seams as shown. Thus, an interface 70 as described above with respect to horizontal seams may also be formed at the vertical seams. According to the present exemplary embodiment, the security mesh 1 is formed so that vertical seams do not overlap, increasing the structural stability of the security mesh 1.

According to another exemplary embodiment, the expandable post may be installed above a ceiling grid in order to allow the security mesh 1 to be installed above the ceiling grid. A building roof typically has pitch, creating a changing building interior ceiling pitch, but a ceiling grid is generally level. Therefore, in order to install the security mesh 1 above the ceiling grid, posts would otherwise have to be cut to size for every change in ceiling pitch where posts need to be installed to support the security mesh 1. As shown in FIG. 1, the expandable post according to the present exemplary embodiment is connected to a ceiling 50 by anchoring the second tube 12 in a hole 51. The first tube 10 is extended in the direction opposite the ceiling 50 so that it contacts an upper surface of a ceiling grid (not shown).

As described above, the ceiling flange 65 of the second sheet 60 is anchored to a ceiling 50. A bolt 44 extends through the ceiling flange 65 to anchor it to the ceiling 50. Although not shown, if the height between the ceiling 50 and the top of the ceiling grid is less than about the length of the second sheet 60, then the opposite end of the second sheet 60 from the ceiling flange 65 may be used to form a base flange. Accordingly, the first sheet 30 may be omitted from the security mesh 1.

The base flange of the second sheet 60 may be substantially similar to the base flange 36 of the first sheet 30, as described above. Likewise, the base flange of the second sheet 60 may be anchored to a floor similar to the floor 20, as described above. The floor 20 may be a foot plate, which is disposed on the top surface of the ceiling grid. Thus, the base flange may be secured to the ceiling grid via the floor plate. This single-sheet security mesh 1 may be utilized in connection with the expandable post to form a security mesh between a ceiling grid and a ceiling, for example.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

I claim:

1. A security mesh, comprising:

a first sheet and a second sheet, wherein:

a first portion of the first sheet is adjacent to a first portion of the second sheet along a first direction;

a second portion of the first sheet overlaps a second portion of the second sheet along a second direction perpendicular to the first direction; and a third portion of the first sheet overlaps a third portion of the second sheet along the first direction;

a fourth portion of the first sheet is anchored to a floor or a base structure; and a fourth portion of the second sheet is anchored to a ceiling or a ceiling structure; and a connector detachably connecting the second portion of the first sheet and the second portion of the second sheet.

2. The security mesh of claim 1, wherein the fourth portion of the first sheet extends along the second direction perpendicular to the first direction, and the fourth portion of the second sheet extends along the second direction perpendicular to the first direction.

3. The security mesh of claim 2, wherein the fourth portion of the first sheet and the fourth portion of the second sheet are separate from and extend parallel to the second portion of the first sheet and the second portion of the second sheet.

4. The security mesh of claim 1, wherein the third portion of the first sheet and the third portion of the second sheet are separate from and extend parallel to the first portion of the first sheet and the first portion of the second sheet.

5. The security mesh of claim 1, wherein:

the connector comprises a first bolt having a length extending along the first direction;

the fourth portion of the first sheet is anchored to the floor or the base structure by a second bolt; and the fourth portion of the second sheet is anchored to the ceiling or the ceiling structure by a third bolt.

6. The security mesh of claim 1, wherein the first sheet and the second sheet each comprise a vertically positioned mesh.

7. The security mesh of claim 6, wherein:

the second portion of the first sheet and the second portion of the second sheet each comprise a horizontally extending mesh portion;

the fourth portion of the first sheet and the fourth portion of the second sheet each comprise a horizontally extending mesh portion; and the second portion of the first sheet and the fourth portion of the first sheet are each integral with the first portion of the first sheet, and the second portion of the second sheet and the fourth portion of the second sheet are each integral with the first portion of the second sheet.

8. The security mesh of claim 7, wherein:

the third portion of the first sheet and the third portion of the second sheet each comprise a vertically extending mesh portion; and the third portion of the first sheet and the third portion of the second sheet are each integral with the first portion of the first sheet and the second portion of the first sheet, and the first portion of the second sheet and the second portion of the second sheet, respectively.

9. The security mesh of claim 8, wherein the first portion of the first sheet, the second portion of the first sheet, and the third portion of the first sheet together have a vertical cross section with a substantially J-shape.

10. The security mesh of claim 8, wherein the second portion of the first sheet, the third portion of the first sheet, the second portion of the second sheet, and the third portion of the second sheet together form an interlocking channel along the length of the first sheet and the second sheet.

11. A security mesh, comprising:

an expandable post; and a first sheet and a second sheet vertically disposed adjacent to each other along and overlapping the expandable post, wherein the first sheet and the second sheet are respectively continuous horizontally in relation to the expandable post, and the first sheet and the second sheet are respectively not separated by the expandable post, wherein:

a first portion of the first sheet is adjacent to a first portion of the second sheet along a vertical direction;

a second portion of the first sheet overlaps a second portion of the second sheet along a horizontal direction extending away from the expandable post.

12. The security mesh of claim 11, wherein:

a third portion of the first sheet overlaps a third portion of the second sheet along the vertical direction; and the third portion of the first sheet and the third portion of the second sheet are separate from and extend parallel to the first portion of the first sheet, the first portion of the second sheet, and the expandable post.

13. The security mesh of claim 12, wherein the expandable post has a first length that is substantially equivalent to a sum of the lengths of the first portion of the first sheet and the first portion of the second sheet.

14. The security mesh of claim 13, wherein the expandable post comprises a first tube and a second tube, the second tube having a second diameter less than a first diameter of the first tube, and the second tube being at least partially disposed in the first tube.

15. The security mesh of claim 14, wherein the expandable post comprises a second length that is not exposed to an outside environment.

16. The security mesh of claim 12, wherein the second portion of the first sheet, the third portion of the first sheet, the second portion of the second sheet, and the third portion of the second sheet together form an interlocking channel along the length of the first sheet and the length of the second sheet.

17. The security mesh of claim 11, wherein:

at least one connector connects the expandable post to the first sheet and the second sheet, and the at least one connector overlaps and extends beyond an entire diameter of the expandable post.

18. A security mesh, comprising:

an expandable post; and a first sheet and a second sheet vertically disposed adjacent to each other along and overlapping the expandable post, wherein the first sheet and the second sheet are respectively continuous horizontally in relation to the expandable post, and the first sheet and the second sheet are respectively not separated by the expandable post, wherein:

a first portion of the first sheet is adjacent to a first portion of the second sheet along a vertical direction;

a second portion of the first sheet overlaps a second portion of the second sheet along a horizontal direction extending away from the expandable post;

a third portion of the first sheet overlaps a third portion of the second sheet along the vertical direction;

the second portion of the first sheet, the third portion of the first sheet, the second portion of the second sheet, and the third portion of the second sheet together form an interlocking channel along a horizontal length of the first sheet and the second sheet;

a fourth portion of the first sheet is anchored to a floor or a base structure;

a fourth portion of the second sheet is anchored to a ceiling or a ceiling structure; and the fourth portion of the first sheet extends along the horizontal direction, and the fourth portion of the second sheet extends along the horizontal direction.

19. The security mesh of claim 18, wherein:

the first portion of the first sheet, the second portion of the first sheet, the third portion of the first sheet, and the fourth portion of the first sheet are integral with each other; and the first portion of the first sheet, the second portion of the first sheet, and the third portion of the first sheet together have a vertical cross section with a substantially J-shape.

20. The security mesh of claim 18, wherein:

the fourth portion of the first sheet is anchored to the floor or the base structure by a first bolt;

the fourth portion of the second sheet is anchored to the ceiling or the ceiling structure by a second bolt;

at least one connector connects the expandable post to the first sheet and the second sheet; and the at least one connector overlaps and extends beyond an entire diameter of the expandable post.

* * * * *